US008492684B2

(12) United States Patent
Gutierrez et al.

(10) Patent No.: US 8,492,684 B2
(45) Date of Patent: Jul. 23, 2013

(54) METHOD FOR DETECTING THE PRESENCE OF A COOKING VESSEL ON AN INDUCTION COOKING HOB AND HOB USING SUCH METHOD

(75) Inventors: Diego Neftali Gutierrez, Varese (IT); Ettore Arione, Leggiuno (IT)

(73) Assignee: Whirlpool Corporation, Benton Harbor, MI (US)

( * ) Notice: Subject to any disclaimer, the term of this patent is extended or adjusted under 35 U.S.C. 154(b) by 831 days.

(21) Appl. No.: 12/581,934

(22) Filed: Oct. 20, 2009

(65) Prior Publication Data

US 2010/0096385 A1 Apr. 22, 2010

(30) Foreign Application Priority Data

Oct. 21, 2008 (EP) ..... 08167098

(51) Int. Cl.
*H05B 6/12* (2006.01)

(52) U.S. Cl.
USPC ..... 219/626; 219/620; 219/621; 219/622; 219/623; 219/624; 219/625; 219/627

(58) Field of Classification Search
USPC ..... 219/620–627
See application file for complete search history.

(56) References Cited

U.S. PATENT DOCUMENTS

| | | | | |
|---|---|---|---|---|
| 3,993,885 | A | 11/1976 | Kominami et al. | |
| 5,136,277 | A * | 8/1992 | Civanelli et al. | 340/568.1 |
| 2008/0290082 | A1 * | 11/2008 | Tallet et al. | 219/452.11 |

FOREIGN PATENT DOCUMENTS

| | | | |
|---|---|---|---|
| EP | 0374868 | A1 | 12/1989 |
| EP | 0374868 | A1 | 6/1990 |
| EP | 0429120 | A2 | 5/1991 |
| EP | 1562405 | A1 | 10/2005 |
| EP | 1793653 | A2 | 6/2007 |
| JP | 2008159494 | A * | 7/2008 |

OTHER PUBLICATIONS

Machine English-language translation of JP 2008159494A to Shiichi et al.*

European Patent Application No. 08167098.6, Filed: Oct. 21, 2008, Applicant: Whirlpool Europe S.r.l., European Search Report dated Feb. 27, 2009.

* cited by examiner

*Primary Examiner* — Matthew W Such
*Assistant Examiner* — Robert Carpenter

(57) ABSTRACT

A method for detecting the presence of a cooking vessel on an induction heating element is disclosed. The induction element is placed below a glass surface and a conductive electrode placed below the glass surface to detect if a cooking utensil is placed on the induction heating element. The electrode measures capacitance, which indicates to the user whether the cooking utensil is present on one or more induction heating elements. After activation by a user, a second detection of the cooking utensil is accomplished by feeding power to the induction heating element and by assessing at least an electrical parameter of a power circuit thereof.

17 Claims, 2 Drawing Sheets

METHOD FOR DETECTING THE PRESENCE OF A COOKING VESSEL ON AN INDUCTION COOKING HOB AND HOB USING SUCH METHOD

BACKGROUND OF THE INVENTION

1. Field of the Invention

The present invention relates to a method for detecting the presence of a cooking utensil on an induction heating element placed below an insulating surface, as well as an induction cooking hob using such method.

2. Description of the Related Art

Nowadays all induction cooktops execute pan detection routines immediately after the user has activated a single induction heating element. The object of the pan detection routine is to assure that a ferromagnetic pan is placed onto the hob in order to prevent potential hazardous situations.

Running pan detection routines implies that power is supplied to the heating element and therefore to the pot. Even though the power is supplied at the minimum level possible, nevertheless the induction hob cannot avoid heating up the pot. Furthermore, whenever the induction power converter is activated, it generates disturbing noise at start. These facts wouldn't be a problem if the user has placed an actual ferromagnetic pot on the hob but, in case a pan or pot not good enough or other metallic objects are placed onto the hob, the above known routine can heat up uselessly and dangerously the metallic object interrupting the normal functioning of the other heating elements of the hob.

Summing up, the drawbacks of this pan known pan detection routine are:

energy is spent uselessly;

there is a noisy audible "click" at start of the routine;

power supply to the other induction heating elements of the hob that are connected to the same induction power converter is interrupted.

Furthermore, pan detection routines might become more and more complicated in case of induction hobs with "mixed" areas as the bridge, multiple-coil expandable or so called "cook anywhere" configuration where the pan can be placed in whatsoever location on the hob. These complex configurations might require the pan detection routine to be executed on each different coil and then it might require an unacceptable time before detecting the pan.

SUMMARY OF THE INVENTION

It is an aspect of the present invention to provide a method and a cooking hob which solve the above mentioned technical problem in an easy and not expensive way.

The above aspect is obtained thanks to the features listed in the appended claims.

According to the invention, instead of analyzing the response of some electrical magnitude while a certain induction heating element is activated for detecting the pan (as done in the known pan detection routines for induction hobs), the basic solution is to detect the ferromagnetic pan by sensing the variation of capacitance measured under the insulating surface, usually a Ceran glass.

Even if the general principle of detecting a pan by means of a capacitor is known in the art of cooking appliance (for instance from EP-A-374868), nevertheless in the art of induction cooking hobs there was a technical prejudice which prevented the designer from adopting a further pan detection system, being already available a detection system based on the assessment of an electrical parameter of the induction electrical circuit. This also prevented a man skilled in the art to solve the above mentioned problems.

BRIEF DESCRIPTION OF THE DRAWINGS

Further advantages and features of the present invention will become clear from the following detailed description, with reference to the attached drawings in which.

DETAILED DESCRIPTION OF THE PREFERRED EMBODIMENTS

According to the drawings, a metallic electrode 10 is placed under a glass ceramic surface G of an induction heating element H. The metallic electrode 10 "sees" a certain capacitance (order of hundreds Pico Farads) between the electrode and ground, according to the following general formula:

$$C = \frac{\varepsilon_0 \varepsilon_r A}{d}$$

where:

E0 is an absolute dielectric constant;

Er is the relative dielectric constant;

A is the area of the condenser surface plate; and d is the distance between the condenser surface plate and ground (i.e. the cooking utensil).

This capacitance is function of the electrode area, the dielectric (for example, the Ceran glass), and the distance between the electrode and ground.

The capacitance is increased significantly if a metallic object is placed onto glass surface G close to the conductive electrode 10.

The technology for sensing the capacitance on a single conductive electrode is well known in the art of cooking appliances.

The advantages of sensing the capacitance variation under the Ceran glass G instead of running automatically the standard pan detection routine are the following:

Avoid heating up the pot uselessly.

It is a "silent" pan detection, as the induction converter doesn't have to be activated.

The sensor can be run continuously, detecting the pan whenever the user places something on it.

In case of complex hob configuration, it can detect quickly where might be the pan and which hobs is covering, avoiding time-consuming high-level procedures.

One of the major advantages of a pan detection method according to the present invention is to use the thermal diffusers that are placed between the coil and the Ceran glass G in today standard induction cooktop (such diffusers being comb-shaped or shaped in order to get a temperature signal representative of the average temperature of the cooking utensil).

Figure 1:
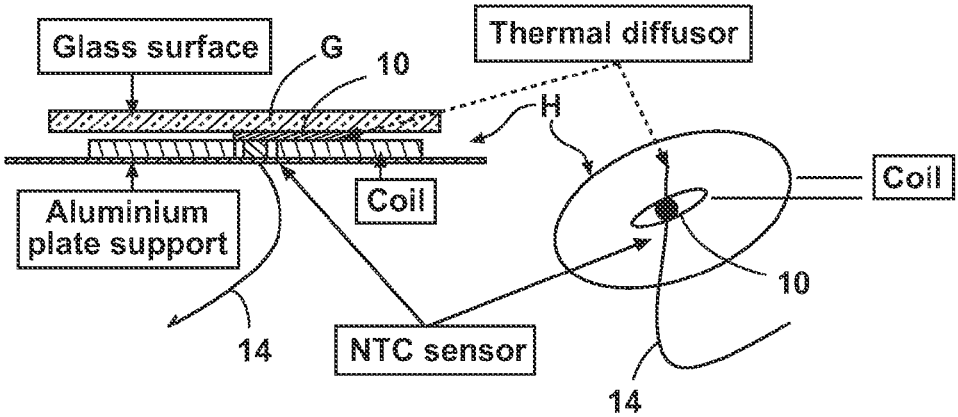
FIG. 1 is a section view and a perspective view of a portion of an induction cooking hob according to the present invention.
Figure 2:
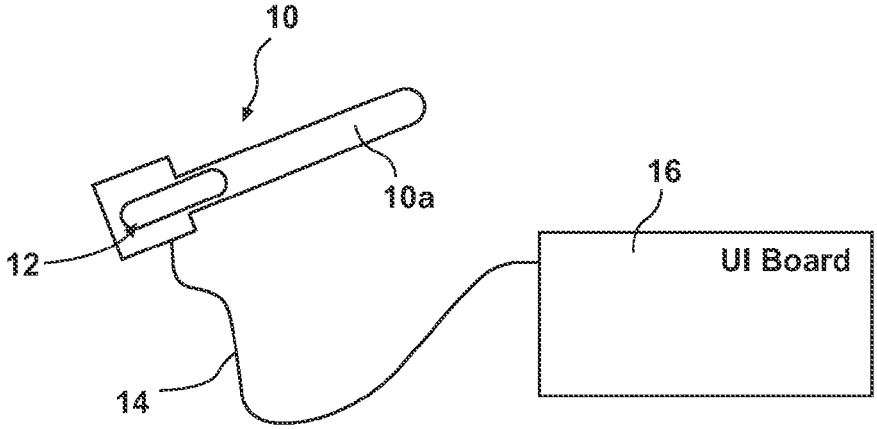
FIG. 2 is a schematic view of a detail of FIG. 1 connected to a user interface of the hob or to a power control board which integrates a user interface board or which communicates with a user interface board.

This thermal diffuser, shown with reference 10*a* in FIG. 2, must have a good thermal contact with the safety NTC-temp sensor 12 (glass temperature sensor) place at coil center, but are galvanic insulated. In addition, these known diffusers are made of electrical conductive material like aluminum. In other words, they can work as a perfect conductive electrode for capacitive sensing.

The diffuser 10*a* is connected with a single electrical conductive wire 14 (FIG. 2) to the user interface board 16 where the capacitive sensor integrated circuit (not shown) is placed. The diffuser 10*a* may also be connected to a power control board (not shown) which integrates a user interface board therein or communicates with a user interface board. It is also possible to use a stand-alone electronic board with the capacitive sensor integrated circuit, that is placed near to the thermal diffuser and that is connected via some kind of communication network with the user interface board.

Figure 3:
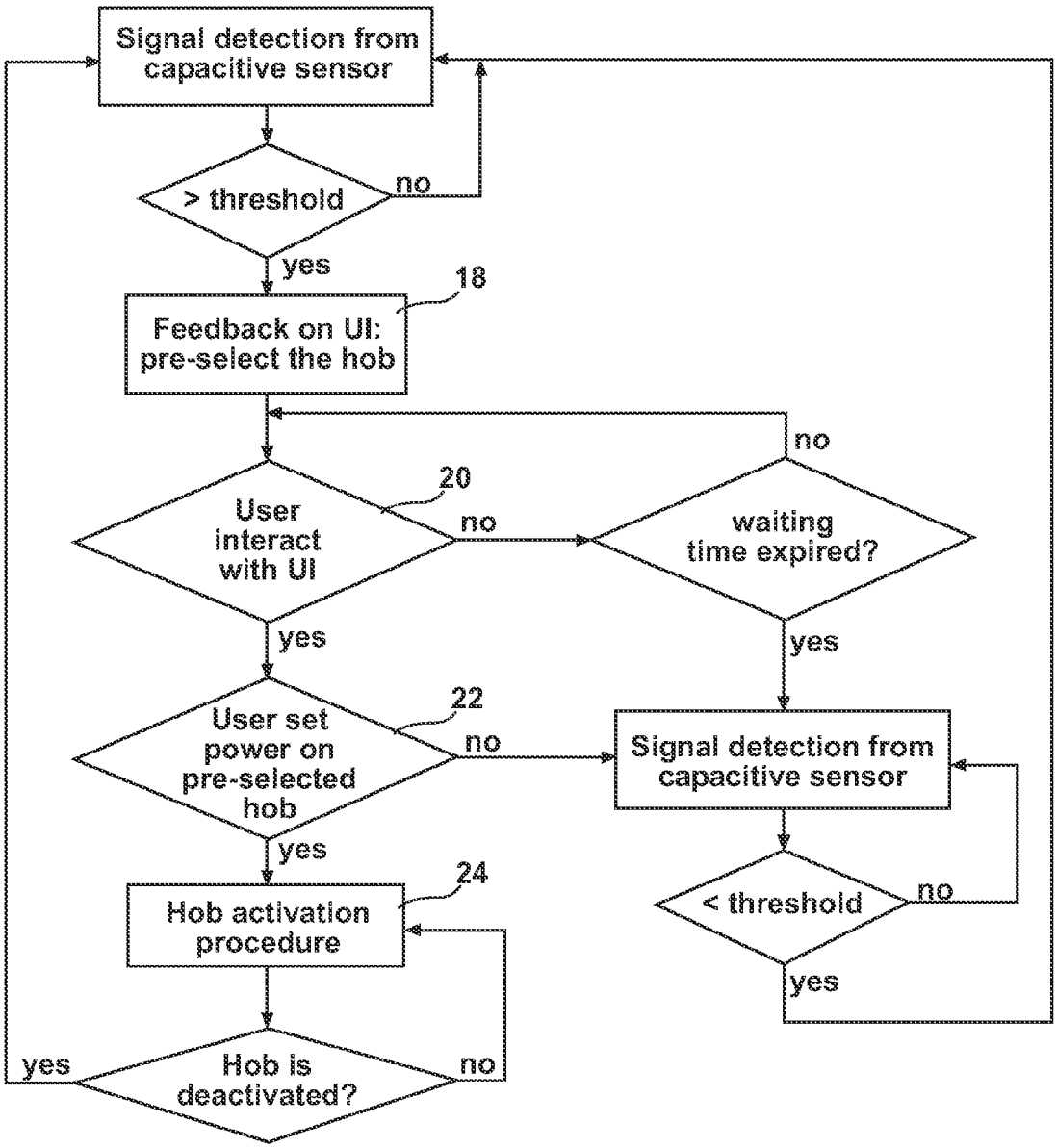
FIG. 3 is a flowchart showing how the pan detection routine according to the invention works.

FIG. 3 shows a flowchart clarifying how the zero-power pan detection routine according to the invention measures continuously the capacitive value and interacts with the user.

According to step 18 of FIG. 3, if the signal from the capacitive sensor 10 is higher than a predetermined threshold, then the user interface presents the user with a pre-selected heating element, eventually the pre-selected heating elements can be more than one depending on the induction heating elements architecture. Then the user has to actually select one from the at least one heating element indicated by the user interface (step 20) and to choose the power level of such element (step 22). Only after this "double" selection the procedure of hob activation is started (step 24).

It is important to point out that this new zero-power pan detection routine does not replace the known standard pan detection for an induction cooking hob, rather it makes it safer, efficient and less energy consuming. Once such novel routine detects a potential pan on the insulating surface, the user interface "proposes" to the user the activation thereof. If the user activates it, then the standard pan detection routine is run.

Once the new heating element has been activated, the zero-power pan detection routine starts over again. It runs continuously even if no heating elements is activated and the UI board 16 and/or power board is in standby mode.

Other metallic electrodes can be used with different shapes (that can be adapted to complex hob configurations) in order to be able to detect specific induction pan with particular shape and size.

Figure 4:
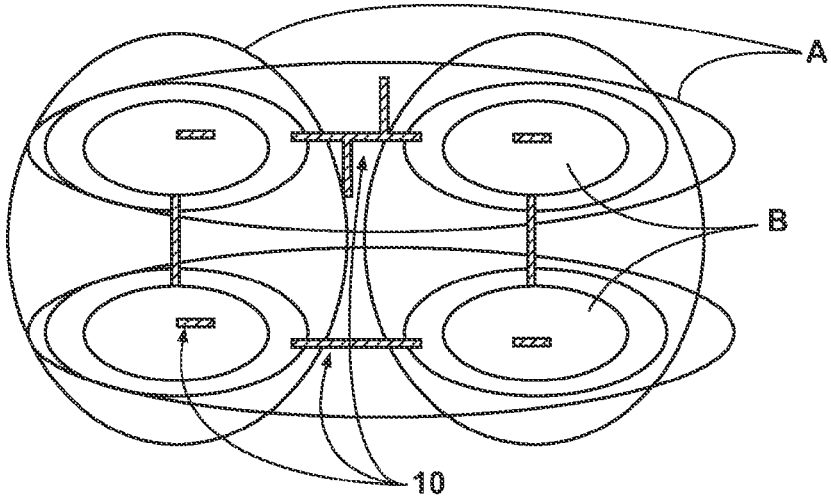
FIG. 4 is a schematic view of an induction cooking hob according to the invention with four hob areas.

As shown in FIG. 4, the electrodes can be placed inside the heating elements and between more than one in order to better fit the multiple zones for induction heating. In FIG. 4 the cap sensors 10 are placed within the hob areas or between hob areas. The sensors 10 can have different shape in order to better cover all the possible heating element zones. With reference A different "bridge" areas are indicated, while with reference B single heating elements are shown.

The invention claimed is:

1. A method for detecting the presence of a cooking utensil on an induction heating element placed below an insulating surface, comprising the steps of:

detecting whether the cooking utensil is placed on the induction heating element by measuring capacitance via a sensor placed below the insulating surface, the sensor is connected to a control board, wherein the sensor is a single conductive electrode configured to measure an electrical parameter and relay the electrical parameter to the control board, and wherein a galvanic insulated temperature sensor is supported by the conductive electrode;

assessing the electrical parameter;

indicating whether the cooking utensil is present on the induction heating element; and activating the indicated induction heating element by feeding power to the indicated induction heating element.

2. The method according to claim 1, wherein the indicating step includes indicating all heating elements that have a cooking utensil placed thereon.

3. The method according to claim 1, wherein the conductive electrode is used for supporting a temperature sensor of the induction heating element.

4. The method according to claim 1, wherein during the assessing step the electrical parameter must surpass a predetermined threshold before the indicating step will follow.

5. The method according to claim 1, wherein one or more cooking utensils are detected on a plurality of induction heating elements, at least one of a plurality of induction heating elements are indicated, and at least one of a plurality of indicated induction heating elements are activated.

6. The induction cooking hob according to claim 5, wherein the control board is connected to a user interface for informing a user which of the plurality of induction heating elements are covered by a cooking utensil.

7. The method according to claim 1, wherein the detection step is performed continuously, such that after completion of the detection method of claim 1 the detection method of claim 1 is repeated one or more times.

8. The method according to claim 1, wherein if, after indicating the presence of the cooking utensil on the induction heating element, the activating step is not performed before a predetermined activation threshold, the detection method of claim 1 is discontinued and after discontinuance the detection step is performed continuously, such that the detection method of claim 1 is repeated one or more times.

9. The method according to claim 1, wherein a power level is selected for the indicated induction heating element.

10. The method according to claim 1, wherein an additional step is performed after activating the indicated induction heating element, wherein a second detection of the cooking utensil if performed by feeding power to the indicated induction heating element and by assessing at least an electrical parameter of a power circuit thereof in response to the activating step.

11. An induction cooking hob comprising:

an insulating surface; and an induction heating element configured below the insulating surface, having a sensor, wherein the sensor is a single conductive electrode, the single conductive electrode is configured substantially centrally within the induction heating element and connected to an electronic unit for detecting the presence of a cooking utensil without activating the induction heating element, wherein a galvanic insulated temperature sensor is supported by the conductive electrode.

12. The induction cooking hob according to claim 11, wherein the conductive electrode is adapted to measure a capacitance value.

13. An induction cooking hob comprising:

an insulating surface;

at least one induction heating element placed below the insulating surface, having a conductive electrode; and an electronic unit connected to a control board, wherein the conductive electrode is substantially centrally placed within the at least one induction heating element and configured to measure an electrical parameter and relay the electrical parameter to the control board without activating the at least one induction heating element, and wherein a galvanic insulated temperature sensor is supported by the conductive electrode.

14. The induction cooking hob according to claim 13, wherein the conductive electrode is connected to the control board via a single electrical conductive wire.

15. The induction cooking hob according to claim 13, wherein the conductive electrode is a thermal diffuser.

16. The induction cooking hob according to claim 13, wherein the conductive electrode is non-symmetrically shaped.

17. The induction cooking hob according to claim 13, wherein at least a second conductive electrode is placed below the insulating surface and between the at least one induction heating element and at least a second induction heating element.

* * * * *